United States Patent [19]

Tocquet et al.

[11] Patent Number: 4,970,706

[45] Date of Patent: Nov. 13, 1990

[54] FLEXTENSOR TRANSDUCER

[75] Inventors: Bernard Tocquet, Sanary; Michel Letiche, Merles, both of France

[73] Assignee: Thomson-CSF, Puteaux, France

[21] Appl. No.: 430,574

[22] Filed: Nov. 1, 1989

[30] Foreign Application Priority Data

Nov. 4, 1988 [FR] France ..... 88 14416

[51] Int. Cl.[5] ..... H04R 17/00

[52] U.S. Cl. ..... 367/158; 367/165

[58] Field of Search ..... 310/337; 367/155, 157, 367/158, 162, 165, 166, 167, 168, 171

[56] References Cited

U.S. PATENT DOCUMENTS

| | | | |
|---|---|---|---|
| 3,274,538 | 9/1966 | Snavely | 367/166 |
| 3,328,751 | 6/1967 | Massa | 367/158 |
| 4,409,681 | 10/1983 | White | 367/159 X |
| 4,420,826 | 12/1983 | Marshall, Jr. et al. | 367/167 |
| 4,731,764 | 3/1988 | Ponchaud | 367/158 |
| 4,764,907 | 8/1988 | Dahlstrom et al. | 367/165 X |
| 4,845,687 | 7/1989 | Bromfield | 367/158 |

FOREIGN PATENT DOCUMENTS 2361033 3/1978 France .

*Primary Examiner*—Brian S. Steinberger

*Attorney, Agent, or Firm*—Oblon, Spivak, McClelland, Maier and Neustadt

[57] ABSTRACT

The disclosed flextensor transducer enables the transmission and reception of acoustic waves in water at very great depths. It includes at least one pillar of piezoelectrical cells placed within an impervious shell. Each pillar is supported solely by a first end on the shell, and is compressed on the shell by a counter-mass applied to its second end.

10 Claims, 3 Drawing Sheets

FLEXTENSOR TRANSDUCER

BACKGROUND OF THE INVENTION

1. Field of the Invention

The present invention concerns a flextensor transducer. It can be applied to the emission or reception of acoustic waves in liquids.

2. Description of the Prior Art

Known flextensor transducers are piezoelectrical transducers generally consisting of a flexible shell that is impervious, with a cylindrical side wall having an elliptical cross section, put into vibration by one or more pillars or bars of piezoelectrical cells made of ceramic. Each pillar is held compressed between those opposite parts that are furthest away from the lateral wall. In emission, an ac electrical field is applied in the longitudinal direction of each pillar and the resultant motion, which takes place along the longitudinal axis of each pillar, is retransmitted, in amplified form, to the surrounding liquid medium. The amplitude of this motion is at its maximum in the plane generated by the small axes of the ellipses formed by each cross section.

The compression of the piezoelectric cells of each pillar is necessary to prevent the breakage of the ceramic when the pillars are subjected to stretching forces.

According to a first known embodiment, this prestressing is given directly by the shell during the assembly of the pillars. Before assembly, housings designed in the shell for the pillars have smaller lengths than those of the pillars. To position the pillars, it suffices to apply two opposite external forces to those facing parts that are closest to the side wall to compress the shell at this place and, through the elastic deformation of this shell, to cause an increase in the length of the housings that is exactly sufficient to enable the installation of the pillars. The prestressing force is applied when the action of the two external forces is eliminated. The pillars then remain compressed in their housing between the parts of the internal side wall of the shell in contact with their ends.

To obtain accurate functioning of the transducers at a determined depth, this embodiment requires that the amplitude of the two external forces should be given a value greater than that normally exerted by the hydrostatic pressure at this depth. This has the drawback of restricting the use of these types of transducers to the depths for which the prestressing force of the pillar can still be ensured, to prevent the breakage of the ceramic forming the piezoelectric cells.

According to a second known embodiment, the prestressing force of each pillar may be obtained by means of a rod going through each pillar along its longitudinal axis, the ends of the rod being held by being bolted to the shell. However, in this case, the hydrostatic pressure exerts a tensile stress on each pillar which, when it is excessive, causes breakage of the ceramic forming the piezoelectric cells.

Finally, according to a third known embodiment, a description of which may be found in the U.S. Pat. No. 4 420 826, the piezoelectric cells may be stacked along a prestressing rod which is not fixed by its ends to the rod. The stack is held by two rails so as not to be subjected, as in the previously described embodiment, to a tensile stress directed along the longitudinal axis of the pillar. However, here again, when the submersion of the transducer is such that one or two sides of the pillar are no longer in contact with the shell, the transducer can no longer work properly.

SUMMARY OF THE INVENTION

The aim of the invention is to overcome the above-mentioned drawbacks.

To this end, an object of the invention is to provide a flextensor transducer of the type comprising at least one pillar of piezoelectric cells placed within a flexible impervious shell, wherein each pillar is held supported solely by a first of its ends on the shell and is compressed on the shell by a counter-mass applied to its second end.

The chief advantage of the invention is that it enables the prestressing force exerted on the pillars to be made independent of the hydrostatic pressure exerted on the shell. Consequently, the transducers thus made can operate at levels of submersion that are far greater than the usual ones.

BRIEF DESCRIPTION OF THE DRAWINGS

Other features and advantages of the invention will appear below from the following description, made with reference to the appended drawings, of which.

DESCRIPTION OF THE INVENTION

Figure 1:
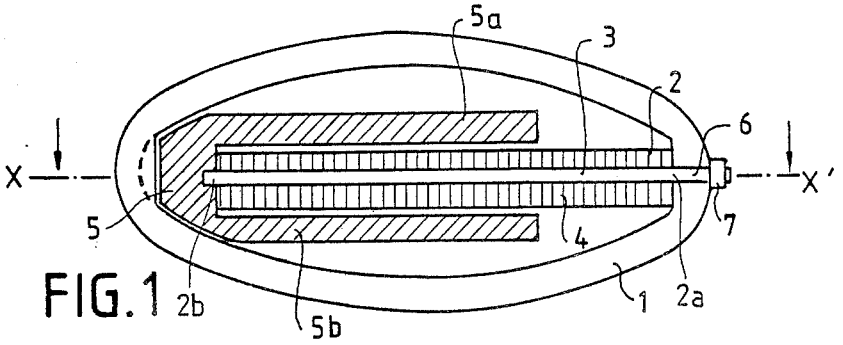
FIG. 1 shows a sectional view of a first mode of assembly of a pillar of photoelectric cells according to the invention.
Figure 2:
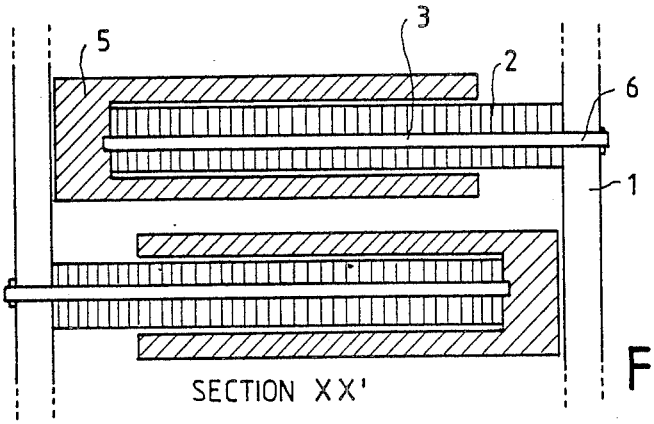
FIG. 2 shows a sectional view of several pillars within the shell of a transducer according to the invention.

A first embodiment of a flextensor transducer according to the invention is described hereinafter with reference to FIGS. 1 and 2. This transducer comprises an elliptical cylindrical shell 1 enclosing at least one pillar 2 formed by the stacking, around a rod 3, of a plurality of piezoelectric cells 4 made of ceramic. Unlike in the embodiments of the above-mentioned prior art devices, the pillar 2 is fixedly joined to the elliptical shell 1 by only one ($2_a$) of its two ends, and the other end $2_b$ supports a counter-mass 5. In this way, the hydrostatic pressure exerted on the shell 1 is no longer transmitted to both ends of the pillars and the pressure limit that defines the limit depth of the use of the transducer is no longer fixed except by the resistance of the shell 1 One mode of assembling the pillar 2 on the shell 1 may consist, for example, in making the rod 3, as in FIG. 1, go through a hole 6 of the shell 1, to screw a first end of the rod 3 into the counter-mass 5 and to bolt its second end to the outer wall of the shell 1 by a circuit 7. As a result, the screwing of the nut 7 to the second end of the rod 3 enables each pillar 2 to be compressed between the counter-mass 5 and the shell 1, and prevents the breakage of the ceramic piezoelectrical cells 4 during operation, when these cells are subjected to an electrical field in the direction of the longitudinal axis of their pillar 2. It can be noted that, in this embodiment, the transducers no longer necessarily have, as did the previously described prior art transducers, the null speed point of their pillar 2, also called a nodal point, placed at their center of symmetry for the position of this point depends, for each pillar, on the shape and mass of its counter-mass 5. However, the . nodal point may be brought closer to the center of symmetry of a pillar, as shown in FIG. 1, by extending each counter-mass 5 by two arms $5_a$ and $5_b$ extending along the pillar 2 without touching it. Possibly, if the pillar 2 has the shape of a cylinder generated by revolution, the two arms $5_a$ and $5_b$ can be reduced to a single arm forming a hood that entirely surrounds one end of the pillar 2, on its entire length or on a part of it.

These arrangements also have the advantage of enabling the use of a volume of piezoelectrical cells almost equal to that occupied by the prior art transducers with equivalent external dimensions.

Figure 3A:
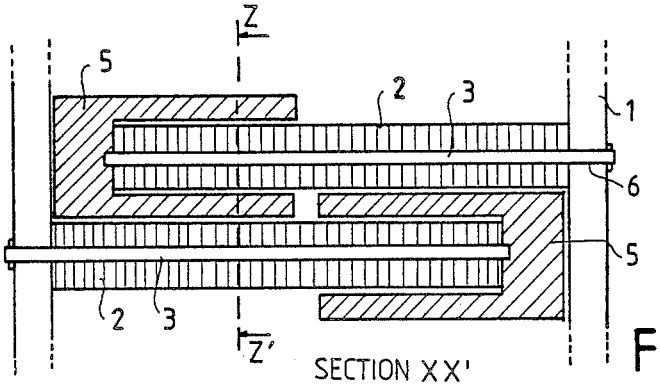
FIGS. 3*a* and 3*b* show a sectional view of a first variant of an assembly according to the invention.
Figure 3B:
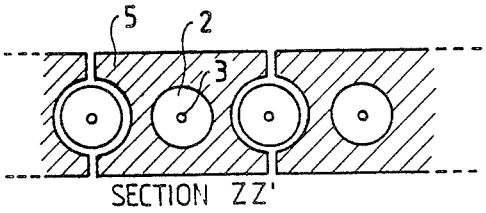
Figure 4:
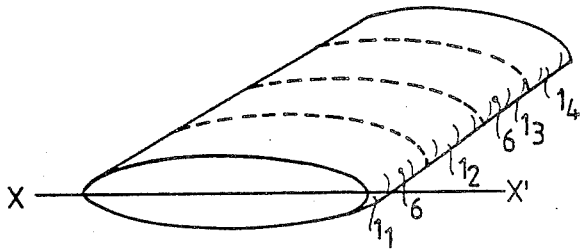
FIG. 4 shows a view in perspective of a transducer shell according to the invention.

According to another alternative embodiment of the invention, shown in FIGS. 3*a* and 3*b*, this volume may be further increased by alternating, as in 2, the fixing of the pillars to the parts of the shell 1 facing the ends of the pillars and by imbricrating the counter-masses 5 between adjacent pillars 2. An external shape of a flextensor transducer according to the above embodiments is shown in FIG. 4. The transducer shown has four elements $1_1$ to $1_4$, each made up of a motor element (the pillar) and a counter-mass, the counter-mass/motor elements being fixed alternately on the fixing surfaces facing the shell in the manner shown in FIGS. 2 and 3*a*. Naturally, without going beyond the scope of the invention, far greater assemblies of motor/counter-mass elements can still be obtained by modifying, if necessary, the order of alternation or of distribution of the fixings of the pillars so as to obtain a resonance of the transducer which is as pure as possible, with the desired acoustic power. The various embodiments of the invention, as described above, make it possible to obtain a resonance frequency of the transducers that is slightly greater, by about 10%, than that commonly given by prior art transducers of equivalent dimensions having no counter-mass. Thus, for a transducer having an overall shell/ceramic mass of 2 kg, a pillar with a diameter of 2 cm. and a length of 10 cm, a counter-mass of 0.5 kg and a Young's modulus for the ceramics of 6.3 10 N/m , the resonance frequency obtained is 3.3 kHz whereas it is 3 kHz with a standard transducer having no counter-mass.

Figure 5:
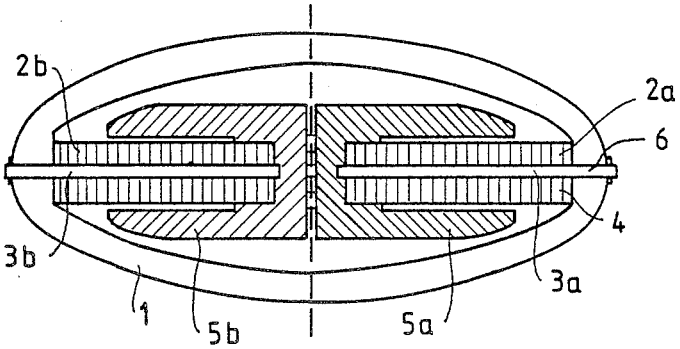
FIG. 5 shows a sectional view of a second variant of an assembly of pillars within the shell of a transducer according to the invention.

However, higher frequencies may be obtained if, in a cross section, the space reserved for each pillar/counter-mass pair occupies, as shown in FIG. 5, only half of the section. This arrangement, which replaces one pillar by two half pillars $2_a$, $2_b$ with the same longitudinal axis, supported by one of their first ends on two opposite parts of the shell 1, ensures the vibrational symmetry of the transducer with greater certainty but, by contrast, the resonance frequency is higher.

The increase in frequency is justified by the fact that the two half-pillars $2_a$, $2_b$ have a smaller length and that their stiffness is thus increased. Thus, with the above characteristics, the reduction in the length of the pillars may take the resonance frequency from 3.3 kHz to 5.2 kHz.

Figure 6:
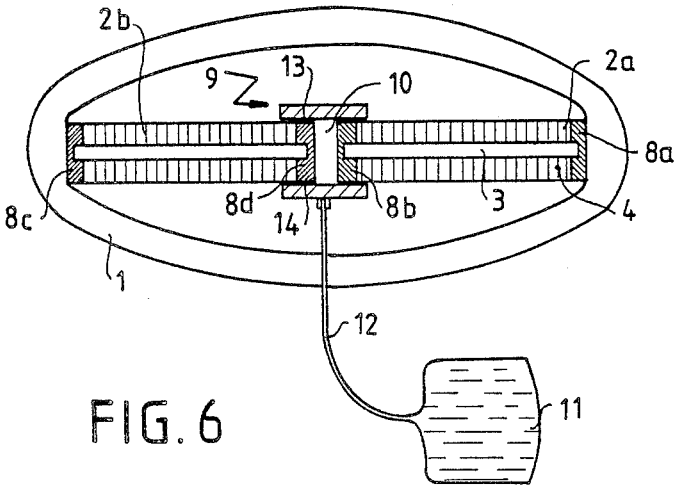
FIG. 6 shows an embodiment of a transducer with a hydraulic counter-mass according to the invention.

An improvement in the embodiment of FIG. 5 is shown in FIG. 6. In this example, the pillars $2_a$ and $2_b$ are provided, at their ends, with two mechanical parts, $8_a$ and $8_b$, $8_c$ and $8_d$ respectively, to set up the prestressing force of the pillars. Unlike in the previous embodiments, the rod, $2_a$, $2_b$ respectively, is not connected directly to the shell and the part, $8_a$, $8_c$, respectively provides for the support of one end of the pillar on the shell 1. Also, unlike in the example of FIG. 5, the rear part $8_d$, $8_b$ respectively, which is not supported on the shell 1, does not have a mass sufficient for it to act as a counter-mass. To ensure the holding of both pillars $2_a$, $2_b$, and to see to it that they behave like a single pillar, a fluid-using device 9 is placed between the ends of the two pillars $2_a$ and $2_b$ which are furthest away from the shell.

This device is formed by an oil-filled cavity 10 connected to an external tank 11 by a capillary tube 12. The cavity 10 is made, for example, by means of a part, with a shape generated by revolution, forming a case, surrounding the two ends of the pillars $2_a$ and $2_b$. At least two elastomer joints 13, 14, provide for the imperviousness of the cavity 10 with the ends of the pillars.

Since the submersion of the tank 11 and that of the transducer are the same, the pressure exerted on the shell 1 is compensated for by the oil pressure so that the pillars $2_a$ and $2_b$ are always applied to the shell 1.

During operation, the tension of the oil film is raised to the working frequency, and gives a high mass at the center of the cavity 10 in a manner identical to that of the prior art. Furthermore, the vibration speed being low since we are at the nodal point, the seals 13, 14 work efficiently.

To obtain accurate operation when the motion is a stretching motion and causes a depression of the oil, this oil is put under over-pressure with respect to the external hydrostatic pressure.

Apart from the fact that, in this last embodiment, the transducer's strength under pressure is remarkable, assembling it is also simple. This is because the assembly is done by the insertion, in only one operation, of the pillars/case unit, connected to the tank 11, into the shell 1, the two pillars $2_a$ and $2_b$ being in contact. It is then enough to put the oil under pressure for the two pillars $2_a$, $2_b$ to move away from each other and for the transducer to be ready to work. Advantageously, each pillar $2_a$, $2_b$ may be possibly placed so that they are supported on the shell 1 through an appropriate housing in the shell 1.

Figure 7:
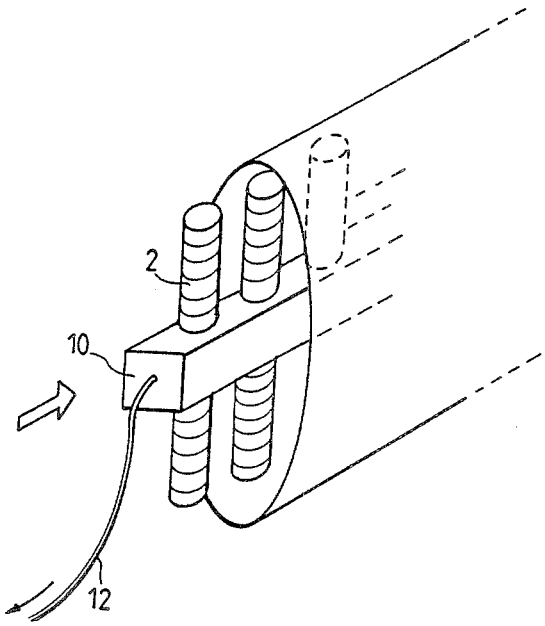
FIG. 7 shows an assembly of a comb of counter-mass hydraulic pillars with a hydraulic counter-mass within a shell of a transducer according to the invention.

According to yet another alternative embodiment, the assembly of a transducer may also be done according to a "combined" method, in the manner shown in FIG. 7, in making the fluid-using case 9 common to all the pillars 2. Under these conditions, the case/pillars unit, which has a herringbone shape, is introduced into the shell 1 in only one operation, and their common case 9 is connected to a single oil tank 11 by the capillary tube 12.

Obviously, numerous modifications and variations of the present invention are possible in light of the above teachings. It is therefore to be understood that within the scope of the appended claims, the invention may be practiced otherwise than as specifically described herein.

What is claimed is:

1. A flextensor transducer of the type comprising one pillar of piezoelectric cells placed within a flexible impervious shell, wherein the pillar is held so as to be supported solely by a first end on the shell and compressed on the shell by a counter-mass applied to a second end.

2. A transducer according to claim 1, wherein the piezoelectric ceramics of the pillar are crossed by a rod fixed by a first end to the shell, and by a second end to the counter-mass.

3. A transducer according to claim 2, wherein the counter-mass is shaped so as to cover, but not touch, each pillar.

4. A transducer according to claim 3, comprising a plurality of pillars having longitudinal axes contained in one and the same plane along parallel directions and which are fixed to the shell alternately.

5. A transducer according to claim 4, wherein each pillar is formed by two half pillars aligned on one and the same longitudinal axis, respectively held so as to be supported by a first end on two opposite parts of the shell.

6. A transducer according to claim 4, wherein the counter-masses are imbricated with one another.

7. A transducer according to claim 1, wherein each pillar is formed by two aligned half pillars, respectively held so as to be supported by a first end on two opposite parts of the shell by a cavity enclosing a fluid under pressure so as to comprise said counter-mass, and into which second ends of the pillars are introduced.

8. A transducer according to claim 6, which comprises a cavity which communicates, through a capillary tube, with the fluid contained in a tank.

9. A transducer according to claim 8, wherein the fluid under pressure is oil.

10. A transducer according to claim 9, wherein the shell is made of an impervious, flexible material, and is formed by a cylindrical, lateral wall with an elliptical section.

* * * * *